United States Patent [19]

Peterson

[11] 3,941,687

[45] Mar. 2, 1976

[54] SOLIDS SEPARATION

[75] Inventor: Lawrence Gordon Peterson, Haddon Township, N.J.

[73] Assignee: Air Products and Chemicals, Inc., Allentown, Pa.

[22] Filed: Sept. 26, 1974

[21] Appl. No.: 509,384

[52] U.S. Cl. ..... 209/136; 209/154

[51] Int. Cl.[2] ..... B07B 4/02

[58] Field of Search ..... 209/133–139 R, 209/140, 141, 3, 156, 157, 32–35, 154

[56] References Cited

UNITED STATES PATENTS

| | | | |
|---|---|---|---|
| 1,356,384 | 10/1920 | Marshall | 209/135 |
| 1,939,121 | 12/1933 | Kent et al. | 209/470 X |
| 1,941,212 | 12/1933 | Johnson | 209/35 X |
| 1,987,640 | 1/1935 | Rothgarn | 209/136 |
| 2,162,392 | 6/1939 | Solomon et al. | 209/137 |
| 2,717,076 | 9/1955 | Leighton et al. | 209/138 |
| 2,791,331 | 5/1957 | Van Drie | 209/134 |
| 3,596,716 | 8/1971 | Hoffman | 209/136 |
| 3,655,043 | 4/1972 | Wochnowski et al. | 209/138 |
| 3,720,307 | 3/1973 | Hukki | 209/135 X |
| 3,738,483 | 6/1973 | MacKenzie | 209/137 X |

*Primary Examiner*—Frank W. Lutter
*Assistant Examiner*—Ralph J. Hill
*Attorney, Agent, or Firm*—James C. Simmons; Barry Moyerman

[57] ABSTRACT

A solids separation system is provided, designed for pneumatic separation of pieces of scrap particularly metallic scrap, into light and heavy fractions. The mixture of pieces of scrap is fed into an enclosed separation vessel wherein they fall by gravity into a horizontally directed stream of air blown into and across the separator vessel, whereby the heaviest pieces fall through the air stream into a heavy solids hopper and the lighter materials are carried downstream by the force of the horizontal air stream into a second hopper. A gas outlet port is provided at the top of the vessel thereby imparting an upward velocity vector to the gas. The horizontal velocity of the gas being reduced by expansion, light metal pieces fall out of the influence of the gas stream into the light solids hopper. Means are provided for adjusting the air flow path from the first into the second hopper comprising a pivoted angularly disposed baffle plate defining the rear wall of the first hopper, the surface of which plate also serves to direct solids intercepted thereby into said first hopper.

4 Claims, 4 Drawing Figures

FIG. 1
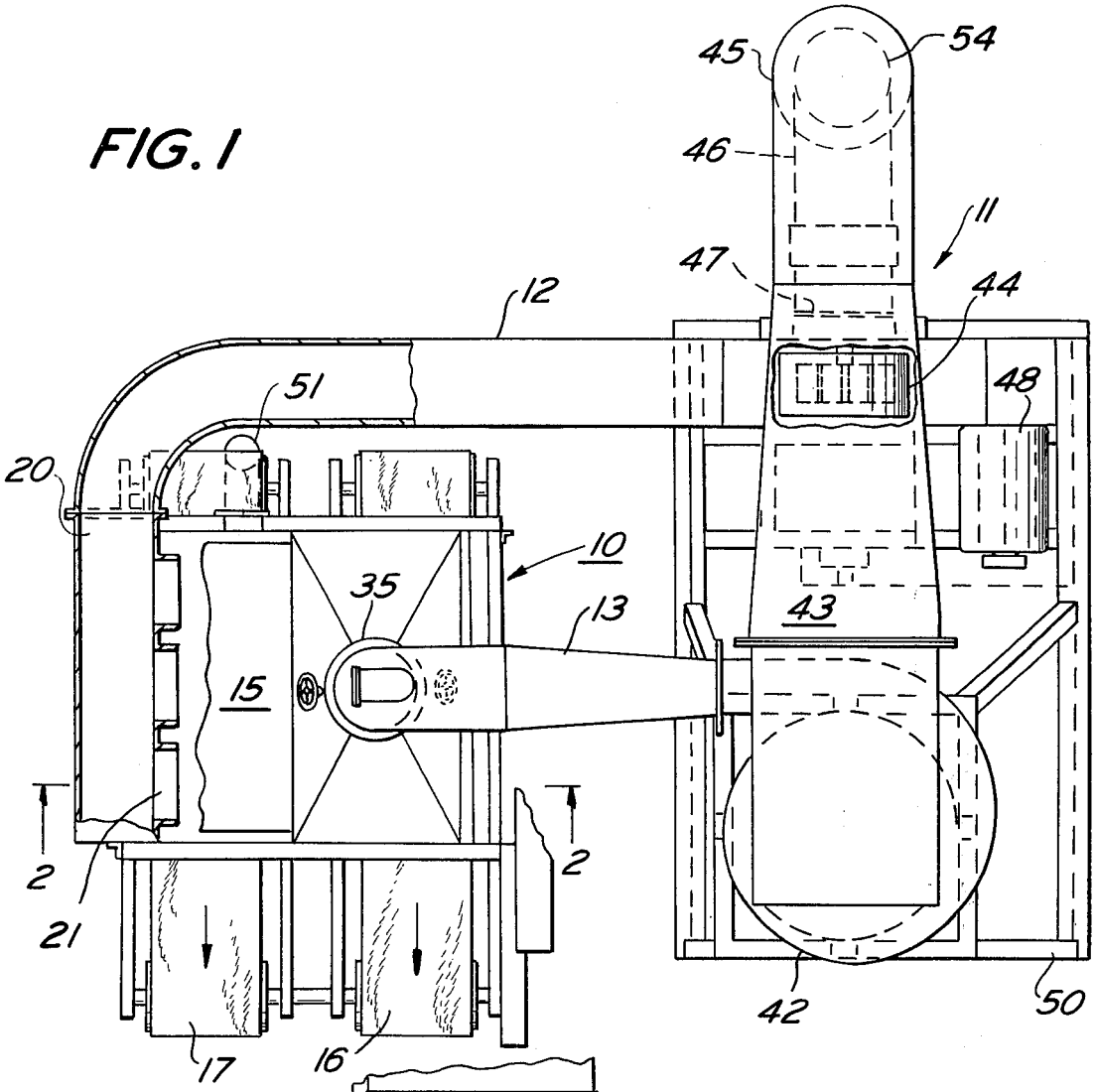
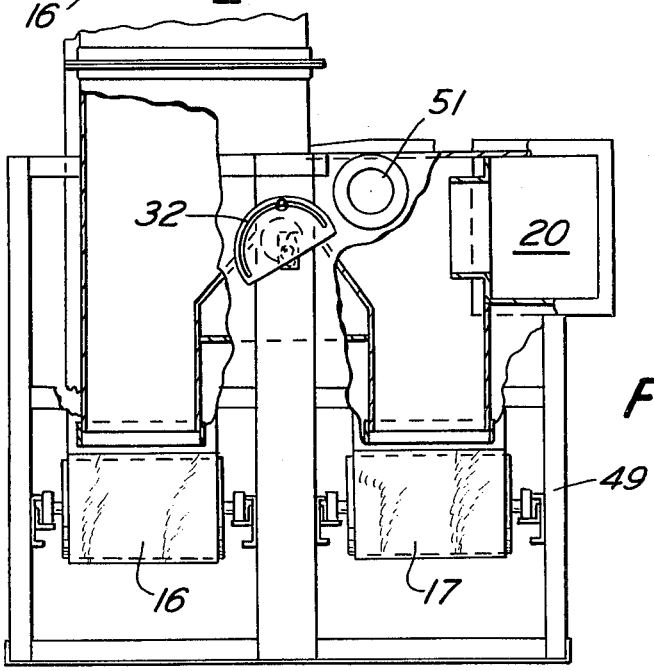
FIG. 4

SOLIDS SEPARATION

BACKGROUND OF THE INVENTION

The present invention relates to apparatus and process for separating a mixture of solid particles into separate light and heavy fractions. The separation system of the invention, while not limited thereto, finds particular use in the scrap metal industry where it can be beneficially applied for the separate recovery of light and heavy metal fractions from crushed scrap, substantially freed of non-metallic components.

It has been known since early times that dry granular materials could be separated by dropping a mixture of such materials through a transverse air blast whereby the trajectory of the falling particles was differentially modified and the lighter particles blown by the air stream through a greater horizontal distance were thus separately recoverable from the heavier materials. Early examples of such devices are illustrated by U.S. Pat. No. 775,965 (1904) proposed for separation of gold from accompanying gravel; and in later U.S Pat. No. 2,791,331 proposed for cleaning gravel to free the same of dirt and light trash or other undesired contaminants. Means are commonly provided in separators of this type for adjusting the feed rate of the granular materials to the separator and the velocity of the air stream and/or the size of the air inlet opening into the separator.

In certain devices of the type described, instead of using positive blowers, the movement of the traversing air stream is effected by suction applied at the air outlet of the separator, as seen for example in U.S. Pat. Nos. 3,005,547 and 3,441,134. The use of a substantially closed air circulating system wherein the air and lightest materials are withdrawn overhead and the air recycled by admission into the suction inlet of a blower discharging to the separator inlet, is disclosed in U.S. Pat. No. 3,655,043.

It has also been proposed, see for example U.S. Pat. No. 1,877,861, to direct a stream of air carrying granular solids into a closed separating chamber communicating with an overhead suction line, wherein the heavier granules drop out of the ascending air stream under the influence of gravity, while the lighter materials are withdrawn overhead into the suction line passing enroute through a cyclone separator in which further separation of the components in the ascending air stream may take place. Other modifications of systems for density separation of solids by an air stream have been described in the art, as for example in U.S. Pat. No. 3,311,234, which features projecting the granular solids into the air stream at a positive inlet velocity normal to the direction of the higher velocity air stream.

SUMMARY OF THE INVENTION

The present invention is concerned with improvements in solids separating devices of the general type of those hereinbefore described, and is particularly designed for more efficient separation of components of metal-containing mixtures of crushed scrap to facilitate the economic separate recovery therefrom of desired metal values such as copper and aluminum, essentially freed of non-metallics such as asbestos, rubber and other insulating materials that may be present in the crushed scrap. The solids separator of the invention has particular advantages when used as a component of systems designed for recovery of copper and aluminum, for example, from scrap comprising discarded electric motors or other similar electrical equipment used on automobiles or in industrial or domestic appliances. The separator of the invention, however, is not limited in its practical application to these purposes since the principles thereof and the improvements therein can be beneficially utilized in other situations, such as in the recovery of reusable metal values from municipal wastes or other sources.

In a preferred embodiment thereof, the separator of the invention comprises principally an enclosed separation vessel provided with means for restricting leakage of air therefrom at the solids feed inlet thereto and at the discharge outlets for the separated solids. Below the feed inlet for the granular solids provision is had for blowing a horizontally directed blast of air across the stream of solid pieces falling therethrough. An adjustable baffle arranged in the path of the air blast controls the available horizontal distance traversed by the solids feed from its point of discharge into the separator to the intercepting baffle and thus serves to divide the heavy granular materials falling thereon from the intermediate fraction of lighter metallic materials blown over the edge of the baffle by the force of the air blast. Further novel means are provided within the separator for controlling the area of discharge of the ascending air stream, containing dust, fluff and other lightest materials, enroute to the overhead gas outlet.

The manner of operation and the applied principles of the device of the invention will be understood and the advantages of the novel features therein more fully appreciated from the detailed description below, read in connection with the accompanying drawings illustrating a preferred embodiment.

FIG. 1 is a top plan view of the apparatus, parts being broken away and shown in cross-section;

FIG. 4 is a partial vertical side view, opposite to that of FIG. 2, with parts in section, and taken along the line 4—4 of FIG. 3.

Figure 3:
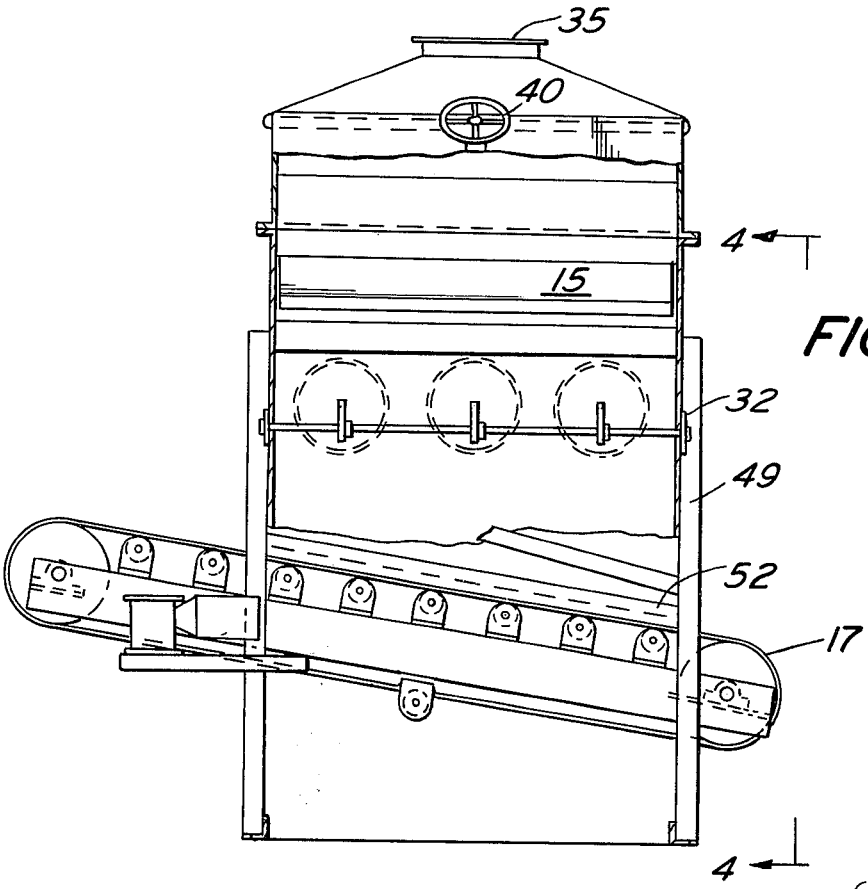
FIG. 3 is a vertical front view taken along the line 3—3 of FIG. 2; with parts broken away and shown in section.
Figure 2:
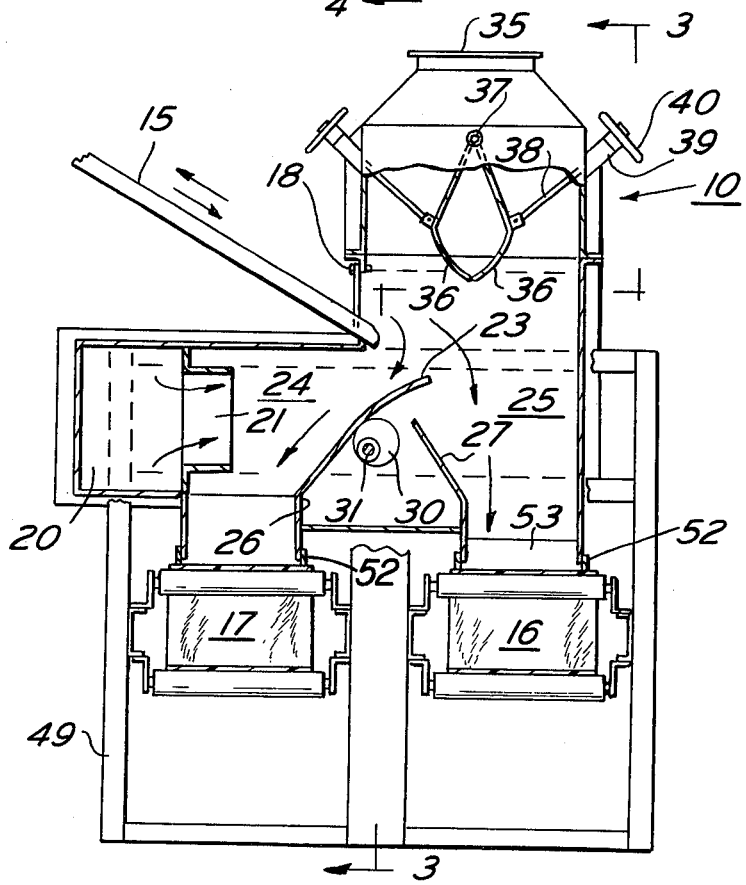
FIG. 2 is a partial vertical side view, with parts in cross-section, taken along the line 2—2 of FIG. 1.

The principal parts of the apparatus as shown particularly in FIG. 1, are comprised of a pneumatic separator 10 and a blower system, 11 communicating with the separator by an air supply duct 12 and a return duct 13. Solids to be separated are charged to separator 10 by conveyor means 15, which may be a vibrating feeder or the like (FIG. 2). The solids, separated into light and heavy fractions, are discharged from the separator 10 onto conveying means which, as shown, may comprise endless belt conveyors, 16 and 17 for the heavy and light fractions, respectively. Other types of discharge conveyors may be employed.

As shown more particularly in FIGS. 1 and 2, air duct 12 discharges into a manifold 20, which is provided with a plurality of distributing ducts 21, directing a substantially horizontal blast of air into the separator 10. In the embodiment illustrated, three such distributing ducts 21 are showh, but it will be understood that a smaller or larger number may be employed. By using a plurality of such distributing ducts 21 a more uniform distribution of the air across the separator 10 is had than could be obtained using a single outlet over the wide area of discharge. Moreover, if desired, further individual control of the velocity of the discharging gas can be achieved by providing individual dampers or other regulating devices at the respective discharge outlets of the ducts 21.

Approximate the point at which the conveyor 15 discharges the feed into a separator 10, an adjustable curtain 18 is provided to limit discharge of air from the separator.

The pieces of metallic scrap, or other material to be separated, are discharged by conveyor 15 directly into the separator and fall by gravity into the air stream. The heavier pieces fall through the air stream and are deflected by angularly disposed baffle plate 23 into separating chamber 24, while the lighter materials are blown beyond the free end of baffle plate 23, into separating chamber 25. Preferably, at least the upper portion of baffle plate 23 is arcuate in configuration. Plate 23 is hinged or otherwise rotatably mounted at its lower end 26, about which it can be pivoted through an arc to adjust the position of the upper end of the baffle plate. Such adjustment of the position of baffle plate 23 sets the outermost point at which the edge of the plate will intercept the falling pieces of scrap to direct the same into heavy-solids receiving chamber 24. While the adjusted position of baffle plate 23 also determines the area of the throat for gas passage from chamber 24 into chamber 25, the gas flow velocity across the separator is principally controlled by other means hereinafter described.

Separation chamber 25 is provided at its inner boundary with an angularly disposed deflecting baffle plate 27. Thus, because of their respective angularly disposed baffle members, the chambers 24 and 25 are of funneled or hopper-shape configuration. The angular position of baffle plate 23 in the embodiment illustrated, is adjusted by a plurality of cam members 30 rotatable about a common shaft 31, which shaft extends beyond the outer wall of separator 10. On the extended end of shaft 31, there is fixedly mounted a selector device 32 (see FIG. 4), by means of which the position of baffle 23 can be adjustably fixed. It will be understood that means other than rotating cams may be employed for adjusting the angular position of baffle 23.

From chamber 24 the heavy pieces of scrap separated therein fall onto an endless conveyor 17, while the lighter pieces separated in chamber 25 discharge onto a similar conveyor 16, by means of which conveyors the separated fractions are transported to separate storage or further treatment.

Separator 10 is provided at the top thereof with a gas discharge outlet port 35. Thus, the air passing through the inlet throat bounded by the edge of plate 23, and expanding therebeyond over the transverse area of the separator, has an upward component of flow velocity imparted thereto. The distribution of the air and its velocity gradient of horizontal flow across the separator is controllably adjusted by means of a pair of throttle plates 36, pivoted on a common shaft 37. The plates 36 are individually movable through respective adjusting screw linkages 38, at least the outer free ends of which linkages are screw-threaded and fitted into internally screw-threaded retainer bearings 39 provided on the opposite side walls near the top of the separator 10. Handwheels 40 are fixedly attached to the outer ends of the linkages 38. Thus, by rotation of a handwheel 40, the throttle plate linked thereto through a screw-threaded member 38 can be swung about its pivot at shaft 37, thereby individually adjusting the throat through which the ascending air must pass, respectively at the side of the separator nearest to and above chamber 24 and that above chamber 25. By such adjustment of the gas blow area between a plate 36 and the adjacent side wall of the separator, the split between particles falling by gravity out of the influence of the air stream flowing into chamber 25 and those carried upwardly by the ascending air to discharge from the separator through outlet 35, can be selectively fixed. Thus, the heaviest metal solids will be directed into chamber 24 and onto solids conveyor 17, lighter metals falling out in chamber 25 will be discharged on conveyor 16, while the lightest essentially non-metallic materials, including pieces of insulation, dust dirt, fluff, etc, will be discharged with the gas stream leaving the separator through outlet port 35. Means similar to linkage 38 and its associated mechanism may be employed, if desired, for adjusting the position of baffle plate 23.

As shown in FIG. 1, the air and solid particles carried thereby, leaving the separator through outlet port 35 flow into communicating duct 13 and are discharged thereby into cyclone separator 42. In the cyclone, the solid particles are centrifugally separated from the air stream. From the top of the cyclone the air, essentially freed of solid contaminant particles, discharges into a duct 43, communicating with the inlet of a radial blower fan housing at 44. Thus, viewed in elevation, the duct 43 comprises a horizontal run from the top of the cyclone (delineated by solid lines in FIG. 1), then turn downwardly through an elbow connection at 45, to flow through an upright section 54 (dotted outline), the lower end of which is connected by an elbow (not shown) to a second horizontal run 46 (shown in dotted outline in FIG. 1), in flow communication with the inlet to the blower housing at 44. Control of air flow into the blower is had by means of a damper as indicated at 47, which constitutes the main control on the recycled air admitted to manifold 20 and discharged into separator 10. The radial fan in housing 44 discharges into air supply duct 12, by means of which the air is delivered to manifold 20 for distribution into separator 10. The fan shown in dotted lines inside housing 44 is driven by a motor 48 connected to the driven shaft of the fan by belt or other suitable mechanical arrangement (not shown).

The separator 10 and associated conveyors are supported by a suitable frame structure generally indicated by 49, while the blower system 11, included the cyclone 42, and the fan blower and motor therefor, are supported in frame structure indicating generally at 50.

To control the static air pressure in the separator 10, a gas vent is provided, as indicated at 51, connected to an exhaust blower (not shown).

Except for the intended air outlets at 35 and the vent provided at 51, uncontrolled escape of air from the separator 10 is restricted by the adjustable curtain 18 at the solids feed inlet thereto and by the provision of bounding curtains 52 at the lateral sides of the belt conveyors 16 and 17 and curtains 53 at the upper and lower ends of these conveyors where they pass under the discharge outlets of chambers 24 and 25. These curtains may be made of heavy impervious textile material, rubber sheet or other flexible plastic.

In the preferred embodiment illustrated the separation vessel is substantially boot-shaped in vertical section, the gas inlet being located at the toe of the boot, the light solids receiving chamber 25 at the heel of the boot, the solids feed inlet at the instep thereof and the gas discharge port at the top of the boot.

While the use of air as the separating gas has been designated, it will be understood that other inert gases may be substituted, particularly in instances in which the material to be treated may present combustion hazards.

In operation of the described system, the stream of crushed scrap material is fed by conveyor 15 to the inlet of separator 10 and the portion comprising essentially metallic solids falls by gravity into the horizontal stream of air blown across the separator from the manifold 20 through the distributing ducts 21. The velocity of the air stream can be varied as desired or required by the nature and composition of the scrap material and the size of the solids pieces, to effect the wanted division between light and heavy fractions. Such control of the air stream velocity can be had, as heretofore explained, by setting the volume of air admitted at the fan inlet through damper 47, and to a minor extent by adjusting the flow area of the air stream at the inlet throat under control of baffle plate 23. The heavy chunks of metal entering the separator fall directly through the air stream into separation chamber 24 and are directed by baffle plate 23 onto the heavy fraction conveyor 17. The lighter material is blown across the separator into separation chamber 25 and falls by gravity out of the influence of the air stream, downwardly onto the light fraction conveyor 16. Very light material including non-metallics such as insulating materials and the like, fluff, dirt, dust, etc., are carried upwardly by the vertical velocity component of the ascending air stream exiting through discharge outlet 35. The velocity of the ascending air stream at the left and right sides of the separator as viewed in FIG. 2 is regulated by the individual adjustment of the angular positions of baffle 36.

The dirt-laden air is fed by duct 13 into the cyclone separator 42 where the insulation materials and other light solids are removed and the clean air is recycled to the fan blower which in turn supplies the duct 12, conducting the blown air to manifold 20.

If the solids feed to the separator consists essentially of crushed metallic scrap which has previously undergone magnetic separation to remove ferrous materials such as iron and steel, the heavy fraction falling out in hopper 24 will generally comprise a product rich in copper. On the other hand, if the original feed scrap contains iron or steel in addition to copper and aluminum, the separated heavy fraction will include these heavier metals falling out in hopper 24 while the aluminum principally will be removed in hopper 25. Separation of copper from iron and steel may then be carried out magnetically or by other known means.

The apparatus of the invention may also be employed in separation of useful values from municipal waste. Such waste may contain, for example, paper, aluminum, steel, glass, organic matter, etc. The operating conditions would accordingly be adjusted to split between a heavy fraction containing the steel, glass and other contained heavy metals from the light fraction composed chiefly of aluminum and organic matter, while lightest materials such as paper, dust, fluff and the like, would be carried off by the air discharged from the separator at port 35 and be removed in cyclone 42.

By adjustment principally of the damper 47 the velocity of the air passing through the throat above the edge of baffle 23 can be varied over a wide range to accommodate the nature and size of the principal components of the feed. The split point between heavy and light fractions will depend upon such factors as respective bulk densities and weight to area ratios of the solids. While not necessarily limited thereto, the scrap charge may comprise pieces of comminuted scrap of about one-half inch (about 1.25 cm) in largest dimensions or larger pieces up to about 3 inches (about 7.6 cm) in major dimension. For separation of such scrap comprising heavy metals such as copper and/or steel admixed with light metals, such as aluminum, the air velocity into chamber 25 may be adjusted accordingly over the range of from about 1000 to 6000 feet/minute (about 300 to 1800 meters/min). On the other hand, for handling municipal waste, lower air velocities can be employed as in the order of 500 feet/minute (150 meters/min). In either case the lightest materials which do not fall out in hopper 25 will be carried off by the air stream to discharge through port 35 and be removed in the cyclone 42.

The simultaneous removal of the very light insulating materials and other contaminants from the metal fractions separated in 10 at this early stage in the overall separation process, is highly beneficial in reducing the bulk of the materials streams, particularly that of the light fraction discharged onto and by conveyor 16. This light fraction will ordinarily require further processing in a secondary recovery section of the plant, for selective separation of the different metal values therein.

What is claimed:

1. A solids separation system for assorting pieces of a mixture fragmented of metal scrap including non-metallic solid contaminants into respective light and heavy metallic fractions, said system comprising:

An enclosed separation vessel having forward and rear walls, means for feeding a mixture of discrete pieces of fragmented metal scrap solids to an inlet of said vessel at said forward wall, for free fall into the vessel, means at said solids inlet to restrict escape of gas from said vessel, means below disposed normal to and laterally apart from said free fall path of said solids fed through said solids inlet for horizontally directing a stream of air into an air inlet of said vessel for flow across said vessel; a heavy-solids receiving chamber at said air inlet into which chamber the air is initially admitted, a light-solids receiving chamber downstream of said air inlet, said heavy-solids receiving chamber having an angularly disposed wall sloping upwardly towards said light-solids chamber, said wall being adjustable to vary its slope, the upper edge of said wall being spaced from said solids inlet to provide an adjustable flow path, by varying the slope of said wall and thus the space between said upper edge and said solids inlet for adjusting gas flow from said heavy-solids chamber into said light-solids chamber, an air discharge port at the upper end of said vessel, whereby the air admitted from said heavy solids chamber into said light solids chamber is induced to flow upwardly toward said discharge port, adjustable first air deflector means below said air discharge port and in the path of the upwardly flowing gas at the forward wall side of the vessel and separately adjustable second air deflector means in the path of the upwardly flowing gas at the rear wall of said vessel, said first and second air deflectors so constructed and arranged to adjust the transverse size of the air flow path formed between each of said air deflectors and the vessel wall adjacent thereto.

2. A solids separation system as defined in claim 1 wherein the angularly disposed wall of said heavy-solids receiving chamber is pivotally mounted at its lower edge for arcuate movement of said wall, whereby the gap between the solids feed inlet and the opposed surface of said wall can be adjusted.

3. The system as defined in claim 2 wherein the angular position of said pivotally mounted wall is adjustable by cam means in contact with said wall.

4. The system as defined in claim 3 wherein said cam means comprises a plurality of laterally spaced cam elements fixedly mounted on a common rotatable shaft.

* * * * *